US008330683B2

(12) United States Patent
Chung et al.

(10) Patent No.: US 8,330,683 B2
(45) Date of Patent: Dec. 11, 2012

(54) DRIVING METHOD OF ORGANIC ELECTROLUMINESCENCE DISPLAY

(75) Inventors: Hoon-Ju Chung, Pyeongtaek-si (KR); Chang-Hoon Jeon, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 987 days.

(21) Appl. No.: 10/962,502

(22) Filed: Oct. 13, 2004

(65) Prior Publication Data

US 2005/0212729 A1 Sep. 29, 2005

(30) Foreign Application Priority Data

Mar. 26, 2004 (KR) ..... 10-2004-0020848

(51) Int. Cl.
*G09G 3/32* (2006.01)

(52) U.S. Cl. ..... 345/82; 345/690

(58) Field of Classification Search ..... 345/76, 345/77, 82, 600, 601, 602, 603, 44, 45, 50, 345/55, 78, 79, 60–63, 690; 315/169.3
See application file for complete search history.

(56) References Cited

U.S. PATENT DOCUMENTS

| | | | | |
|---|---|---|---|---|
| 5,724,058 | A * | 3/1998 | Choi et al. | 345/89 |
| 5,818,419 | A * | 10/1998 | Tajima et al. | 345/691 |
| 5,940,142 | A * | 8/1999 | Wakitani et al. | 348/671 |
| 6,091,396 | A * | 7/2000 | Minami et al. | 345/690 |
| 6,452,341 | B1 * | 9/2002 | Yamauchi et al. | 315/169.1 |
| 6,956,592 | B2 * | 10/2005 | Yamada et al. | 345/691 |
| 7,023,141 | B2 * | 4/2006 | Anzai et al. | 315/169.3 |
| 7,230,591 | B2 * | 6/2007 | Inukai | 345/76 |
| 7,239,083 | B2 * | 7/2007 | Koyama | 313/506 |
| 2001/0028347 | A1 * | 10/2001 | Kawahara et al. | 345/204 |
| 2001/0043169 | A1 * | 11/2001 | Salters et al. | 345/60 |
| 2002/0021266 | A1 * | 2/2002 | Koyama et al. | 345/76 |
| 2002/0036650 | A1 * | 3/2002 | Kasahara et al. | 345/639 |
| 2002/0042152 | A1 * | 4/2002 | Yamazaki et al. | 438/4 |
| 2004/0041756 | A1 * | 3/2004 | Henmi et al. | 345/76 |
| 2004/0160401 | A1 * | 8/2004 | Hoppenbrouwers et al. | 345/89 |

FOREIGN PATENT DOCUMENTS

| | | |
|---|---|---|
| CN | 1269900 | 10/2000 |
| CN | 1377496 | 10/2002 |
| JP | 10-116053 | 5/1998 |
| JP | 2002-242226 | 9/2000 |

(Continued)

OTHER PUBLICATIONS

Takashi Nanmoto et al.; "Optimization of a Time Ratio Gray Scale Method for OLED Display"; (IDW '03); (pp. 263-266).

(Continued)

*Primary Examiner* — Chanh Nguyen
*Assistant Examiner* — Pegeman Karimi
(74) *Attorney, Agent, or Firm* — McKenna Long & Aldridge LLP

(57) ABSTRACT

A driving method of a flat panel display includes dividing one frame into a plurality of sub-frames, wherein each sub-frame includes an on-state time, each on-state time corresponds to a weight value, and at least one of the weight values is expressed in the form of a non-binary code; applying an on-state gate signal to a pixel in each sub-frame to turn on the pixel; and applying each bit of a data signal corresponding to each sub-frame to the pixel.

25 Claims, 4 Drawing Sheets

FOREIGN PATENT DOCUMENTS

| | | |
|---|---|---|
| JP | 2002-032050 | 1/2002 |
| JP | 2003-043977 | 2/2003 |
| JP | 2003-316322 | 11/2003 |
| JP | 2004-070074 | 3/2004 |
| KR | 2002-0018975 | 9/2002 |
| KR | 10-0420426 B1 | 2/2004 |
| WO | WO 03041042 | 5/2003 |

OTHER PUBLICATIONS

Kazutaka Inukai et al.; "Late-News Paper: 4.0-in. TFT-OLED Displays and a Novel Digital Driving Method"; (SID 00 Digest); (pp. 924-927).

* cited by examiner

DRIVING METHOD OF ORGANIC ELECTROLUMINESCENCE DISPLAY

The present invention claims the benefit of Korean Patent Application No. 2004-20848 filed in Korea on Mar. 26, 2004, which is hereby incorporated by reference for all purposes as if fully set forth herein.

BACKGROUND OF THE INVENTION

1. Field of the Invention

The present invention relates to an organic electro-luminescence display (OELD), and more particularly, to a driving method of an OELD that can improve the image quality.

2. Discussion of the Related Art

Until recently, display devices generally have employed cathode-ray tubes (CRTs). Presently, many efforts are being made to study and develop various types of flat panel displays, such as liquid crystal display devices (LCDs), plasma display panel (PDPs), field emission displays, and electro-luminescence displays (ELDs), as substitutes for CRTs. Of these flat panel displays, the PDP has advantage of large display size, but has disadvantage of low lightness and high power consumption. The LCD has advantage of thin profile and low power consumption, but has disadvantage of small display size. The OELD is a luminescent display and has advantage of fast response time, high lightness and wide viewing angle.

FIG. 1 is a cross-sectional view of an organic electro-luminescent diode of an OELD according to the related art.

In FIG. 1, the organic electro-luminescent diode includes an anode 2, a hole injection layer 3, an emitting layer 4, an electron injection layer 5 and a cathode 6 disposed in sequence on a substrate 1. The anode 2 and cathode 6 are supplied with driving voltages, and a hole in the hole injection layer 3 and an electron in the electron injection layer 5 move to the emitting layer 4 to emit light. Accordingly, the emitted light from the emitting layer 4 displays images.

In general, the OELD displays images with gray-levels by an area division driving method or a time division driving method. The area division driving method is a driving method that expresses gray-levels through multiple sub-pixels, which constitute one pixel and operate in accordance with multiple data signals corresponding to the multiple sub-pixels. Accordingly, the OELD driven by the area division driving method has a complex pixel structure. On the contrary, the time division driving method is a driving method that expresses gray-levels through multiple sub-frames, which constitute one frame interval. In the time division driving method, a pixel is on or off-state during each sub-frame. Accordingly, a gray-level is displayed by the summation of the on-state times of the sub-frames during one frame interval. Because the response time of the OELD is relatively fast compared with other flat panel displays, the time division driving method has been employed to drive the OELD efficiently.

FIG. 2 is a timing diagram for the time division driving method according to the related art to drive an OELD.

Table 1 shows an on-state time of each sub-frame to display a gray-level.

TABLE 1

| Sub-frames on-state time LT (weight value) | | SF8 128 | SF7 64 | SF6 32 | SF5 16 | SF4 8 | SF3 4 | SF2 2 | SF1 1 |
|---|---|---|---|---|---|---|---|---|---|
| gray-level (data signal) | . | . | . | . | . | . | . | . | . |
| | . | . | . | . | . | . | . | . | . |
| | . | . | . | . | . | . | . | . | . |
| | 125 | 0 | 1 | 1 | 1 | 1 | 1 | 0 | 1 |
| | 126 | 0 | 1 | 1 | 1 | 1 | 1 | 1 | 0 |
| | 127 | 0 | 1 | 1 | 1 | 1 | 1 | 1 | 1 |
| | 128 | 1 | 0 | 0 | 0 | 0 | 0 | 0 | 0 |
| | 129 | 1 | 0 | 0 | 0 | 0 | 0 | 0 | 1 |
| | . | . | . | . | . | . | . | . | . |
| | . | . | . | . | . | . | . | . | . |
| | . | . | . | . | . | . | . | . | . |

In FIG. 2 and Table 1, a data signal is an eight-bit binary code and has 256 ($2^8$) gray-level information. According to the time division driving method according to the related art, one frame interval F is divided into first to eighth sub-frames SF1 to SF8, and the first to the eight sub-frames correspond to the lowest to the highest bits of the eight-bit data signal, respectively. In other words, the first bit (the lowest bit) of the data signal corresponds to the first sub-frames SF1, and the second to the eighth bits of the data signal correspond to the second to the eighth sub-frames SF2 to SF8, respectively.

Each sub-frame SF has an on-state time LT and an off-state time UT. Because the pixels of the OLED are scanned along a vertical direction V-scan during each sub-frame SF, each on-state time LT follows the oblique line in FIG. 2 along the vertical direction V-scan. The on-state lime LT of each sub-frame SF corresponds to a weight value, which is the binary exponent of the binary code, of each bit of the data signal. Accordingly, the on-state time LT of each sub-frame SF is expressed in the form of a binary code, and the weight values of the first to the eighth on-state times LT1 to LT8 have the following relationship: LT1:LT2:LT3:LT4:LT5:LT6:LT7:LT8$=2^0:2^1:2^2:2^3:2^4:2^5:2^6:2^7$.

The pixel emits light when the corresponding bit of the data signal has a logic value "1", and does not emit light when the corresponding bit of the data signal has a logic value "0" during each frame SF. Accordingly, the on-state time LT is the emission time of the pixel when the logic value is "1". Thus, a gray-level can be displayed by the summation of the emission times during one frame interval F.

When gray-levels are displayed by the time division driving method according to the related art, all or some of the corresponding bits of the data signals, which display different gray-levels, may have different logic values.

For example, a first data signal is an eight-bit binary code of "01111111" for displaying the $127^{th}$ gray-level, which is the $(2^n-1)^{th}$ gray-level when n equals to 8. Further, a second data signal is an eight-bit binary code of "10000000" for displaying the $128^{th}$ gray-level, which is the $(2^n)^{th}$ gray-level when n equals to 8. While a first pixel supplied with the first data signal emits light during the first to the seventh sub-frames SF1 to SF7, a second pixel supplied with the second data signal emits light only during the eighth sub-frame SF8. Accordingly, the first pixel displaying the $127^{th}$ gray-level and the second pixel displaying the $128^{th}$ gray-level emit light alternatively. The percentage of the alternative emission time for the first pixel during the first to the eighth sub-frames SF1 to SF8 is 100% (127/127*100), and the percentage of the alternative emission time for the second pixel is also 100% (128/128*100).

In addition, a third data signal is an eight-bit binary code of "10011111" for displaying the $159^{th}$ gray-level, when the first data signal is the eight-bit binary code of "01111111" for displaying the $127^{th}$ gray-level. The first data signal and the third data signal have different logic values in the sixth, seventh and eighth bits. Accordingly, the first pixel displaying the $127^{th}$ gray-level and a third pixel displaying the $159^{th}$ gray-level emit light alternatively during the sixth to the eighth sub-frames SF6 to SF8. The percentage of the alternative emission time for the first pixel during the sixth to the eighth sub-frames SF6 to SF8 is 76% ((32+64+0)/127*100), and the percentage of the alternative emission time for the third pixel is 81% ((0+0+128)/159*100).

As shown by the above examples, all or some of the corresponding bits of the data signals, which display different gray-levels, may have different logic values. In addition, the alternative emission times occupies most of the emission times of the pixels, when the orders of the corresponding bits having different logic values are high.

Because the data signal is a multiple-bit binary code, and the on-state time of each sub-frame is expressed in the form of a binary code and is equal to the weight value (the binary exponent) in the related art, the on-state time increases with the binary exponent in accordance with the order of the bit. Accordingly, the pixels displaying different gray-levels emit light alternatively during most of the emission times, when the orders of the corresponding bits having different logic values are high. Thus, the OELD driven by the time division driving method according to the related art has problems in that a border flicker phenomenon occurs when a static image is displayed, and a dynamic false contour phenomenon occurs when a dynamic image is displayed.

SUMMARY OF THE INVENTION

Accordingly, the present invention is directed to a driving method of an organic electro-luminescence display that substantially obviates one or more of problems due to limitations and disadvantages of the related art.

An advantage of the present invention is to provide a driving method of an organic electro-luminescence display that can improve the image quality.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a driving method of a flat panel display includes dividing one frame into a plurality of sub-frames, wherein each sub-frame includes an on-state time, each on-state time corresponds to a weight value, and at least one of the weight values is expressed in the form of a non-binary code; applying an on-state gate signal to a pixel in each sub-frame to turn on the pixel; and applying each bit of a data signal corresponding to each sub-frame to the pixel.

In another aspect of the present invention, a flat panel display a timing controller for dividing one frame into a plurality of sub-frames, wherein each sub-frame includes an on-state time, each on-state time corresponds to a weight value, and at least one of the weight values is expressed in the form of a non-binary code; a gate driver for applying an on-state gate signal to a pixel in each sub-frame to turn on the pixel; and a data driver for applying each bit of a data signal corresponding to each sub-frame to the pixel.

In yet another aspect of the present invention, a driving method of a flat panel display device having a pixel includes dividing one frame into a plurality of sub-frames, wherein each sub-frame includes an on-state time; converting a N-bit source data signal to a M-bit data signal, the M-bit data signal having both a binary code and a non-binary code, wherein each of N and M is an integer, M is greater than N, a number of the sub-frames is equal to M, and each bit corresponds to a weight value of the on-state time of each sub-frame; and applying each bit of the M-bit data signal to the pixel in each sub-frame.

In still another aspect of the present invention, a driving method of a flat panel display includes dividing one frame into a plurality of sub-frames, wherein each sub-frame includes an on-state time; converting a N-bit source data signal to a M-bit data signal, the M-bit data signal having both a binary code part and a non-binary code part, wherein each of N and M is an integer, M is greater than N, each bit corresponds to a weight value, a number of the sub-frames is equal to M; and applying each bit of the M-bit data signal to the pixel in each sub-frame, wherein the weight value of a higher bit is less than or equal to the summation of the weight values of two lower bits in the non-binary code part.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to the embodiments of the present invention, examples of which are illustrated in the accompanying drawings.

Figure 3:
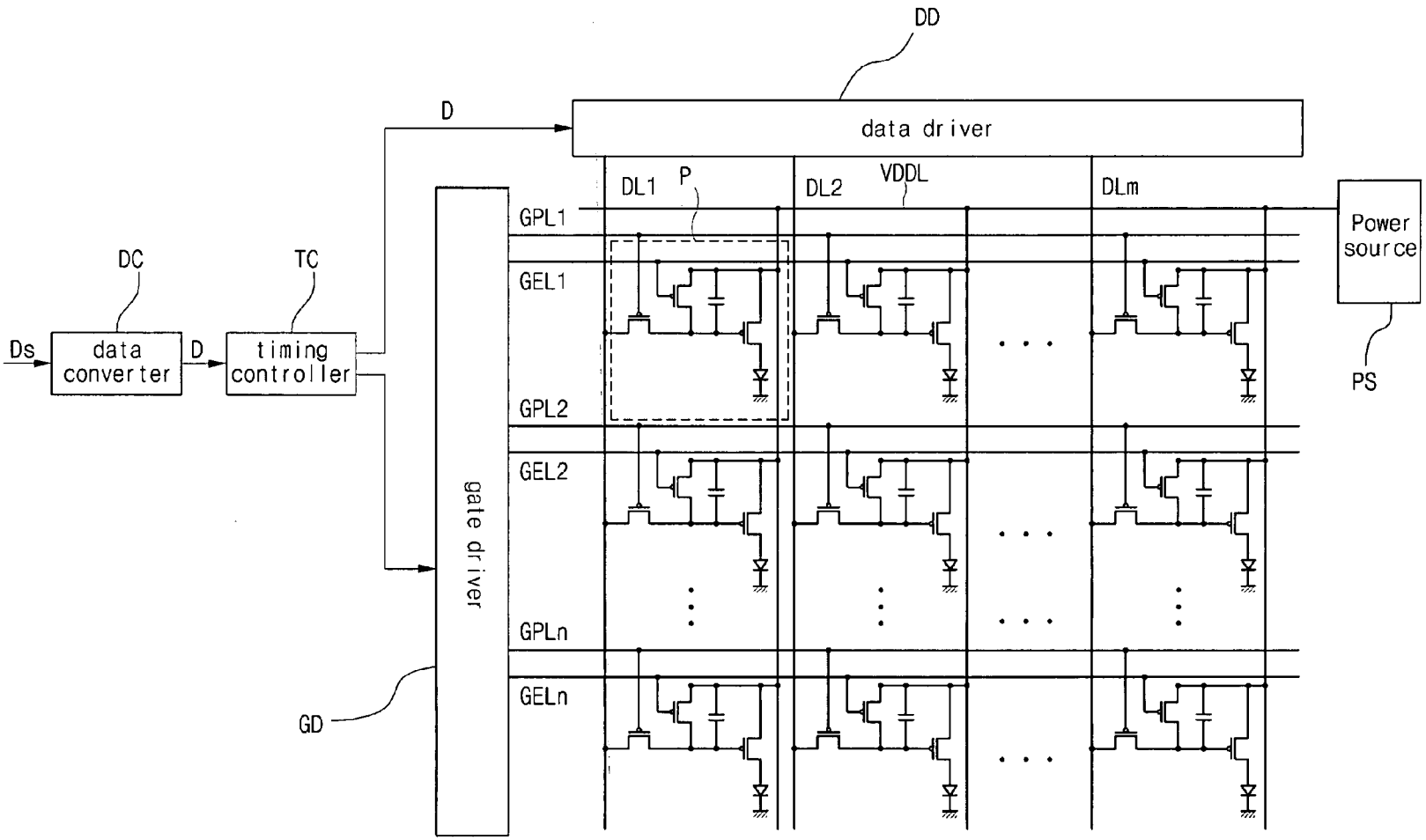
FIG. 3 is a schematic view of an OELD driven by a time division driving method according to an embodiment of the present invention.
Figure 4:
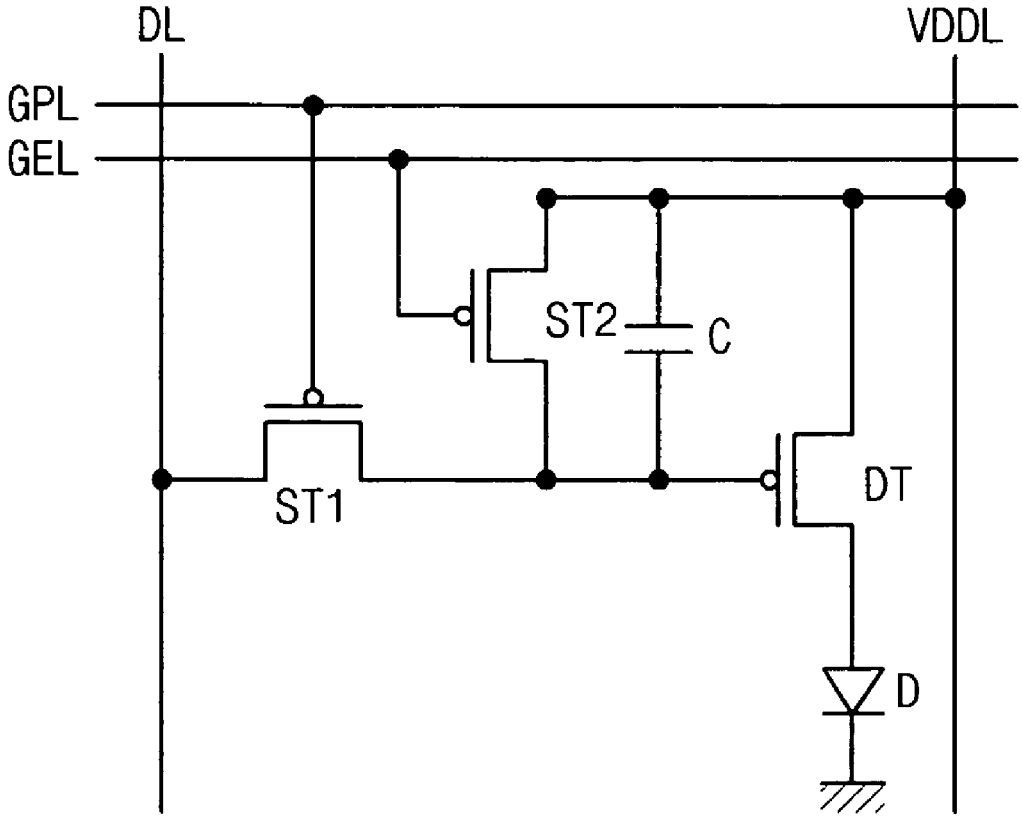
FIG. 4 is an enlarged view of a pixel in FIG. 3.

FIG. 3 is a schematic view of an OELD driven by a time division driving method according to an embodiment of the present invention, and FIG. 4 is an enlarged view of a pixel in FIG. 3.

Referring to FIGS. 3 and 4, the OELD includes a pixel P, a data line DL, an on-state gate line GPL and an off-state gate line GEL crossing the data line DL, a power line VDDL, a data driver DD, a gate driver GD, a timing controller TC, a data converter DC, and a power source PS. The data line DL, one of the on-state and off-state gate lines GPL and GEL, and the power line VDDL define a pixel P.

The pixel P includes first and second switching transistors ST1 and ST2, a driving transistor DT, a storage capacitor C and an organic electro-luminescent diode D. A gate electrode and a source electrode of the first switching transistor ST1 are connected with the on-state gate line GPL and the data line DL, respectively, and a drain electrode of the first switching transistor ST1 is connected with the driving transistor DT, the source electrode of the second switching transistor ST2 and a first capacitor electrode of the storage capacitor C. The first switching transistor ST1 becomes on or off-state in accordance with an on-state gate signal supplied to the on-state gate line GPL.

The first capacitor electrode and a second capacitor electrode of the storage capacitor C are connected with the gate electrode and the source electrode of the driving transistor DT, respectively. The storage capacitor C stores a gate-source voltage of the driving transistor DT. A source electrode and a drain electrode of the driving transistor DT are connected with the power line VDDL supplying a power signal and the organic electro-luminescent diode D, respectively. A gate electrode of the second switching transistor ST2 is connected with the off-state gate line GEL. The second switching transistor ST2 becomes on or off-state in accordance with an off-state gate signal supplied to the off-state gate line GEL.

Figure 1:
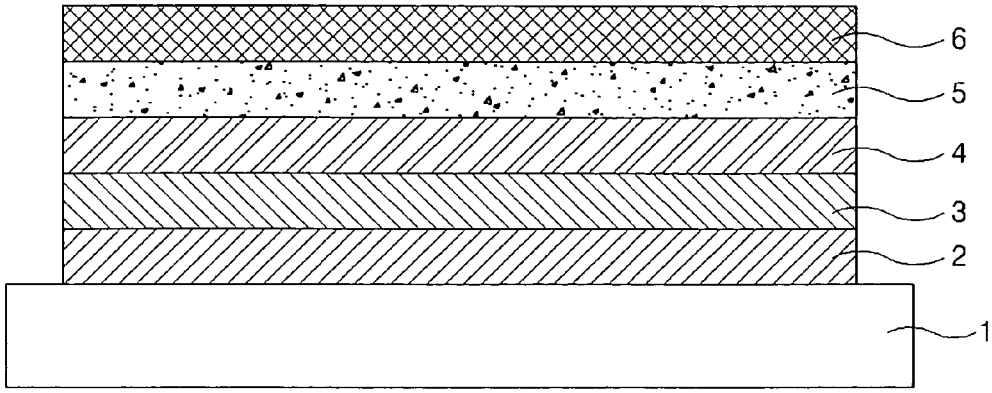
FIG. 1 RELATED ART
FIG. 1 is a cross-sectional view of an organic electro-luminescent diode of an OELD according to the related art.
Figure 2:
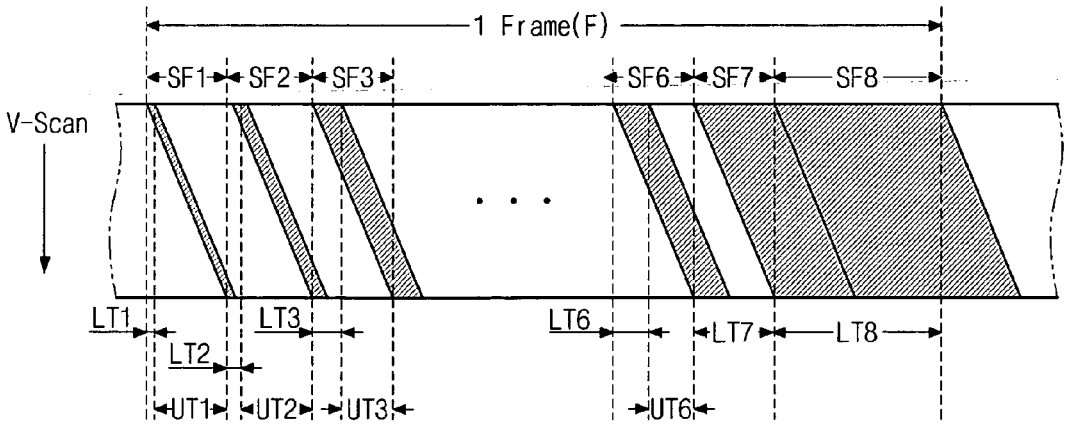
FIG. 2 RELATED ART
FIG. 2 is a timing diagram for the time division driving method according to the related art to drive an OELD.

The organic electro-luminescent diode D includes a first electrode connected with the driving transistor DT, a second electrode connected with a terminal supplying a low signal such as a ground terminal, and an organic luminescent layer between the first and the second electrodes. The first and second electrodes may be expressed as an anode and a cathode. The organic luminescent layer may include a hole injection layer, an electron injection layer and an emitting layer (in FIG. 1). The organic electro-luminescent diode D is supplied with the power signal when the driving transistor is on-state, and the emitting layer emits light, thereby displaying images.

The data driver DD supplies a data signal D to the pixel P through the data line DL. The gate driver GD supplies the on-state and off-state gate signals to the pixel P through the on-state and off-state gate lines GPL and GEL, respectively.

The timing controller TC supplies the data signal D to the data driver DD in accordance with a timing sequence, controls the data driver DD and the gate driver GD, and divides one frame into a plurality of sub-frames.

The data converter DC converts a source data signal Ds to the data signal D having more bits than the source data signal Ds. The power source PS supplies the power signal to the pixel P through the power line VDDL.

Figure 5:
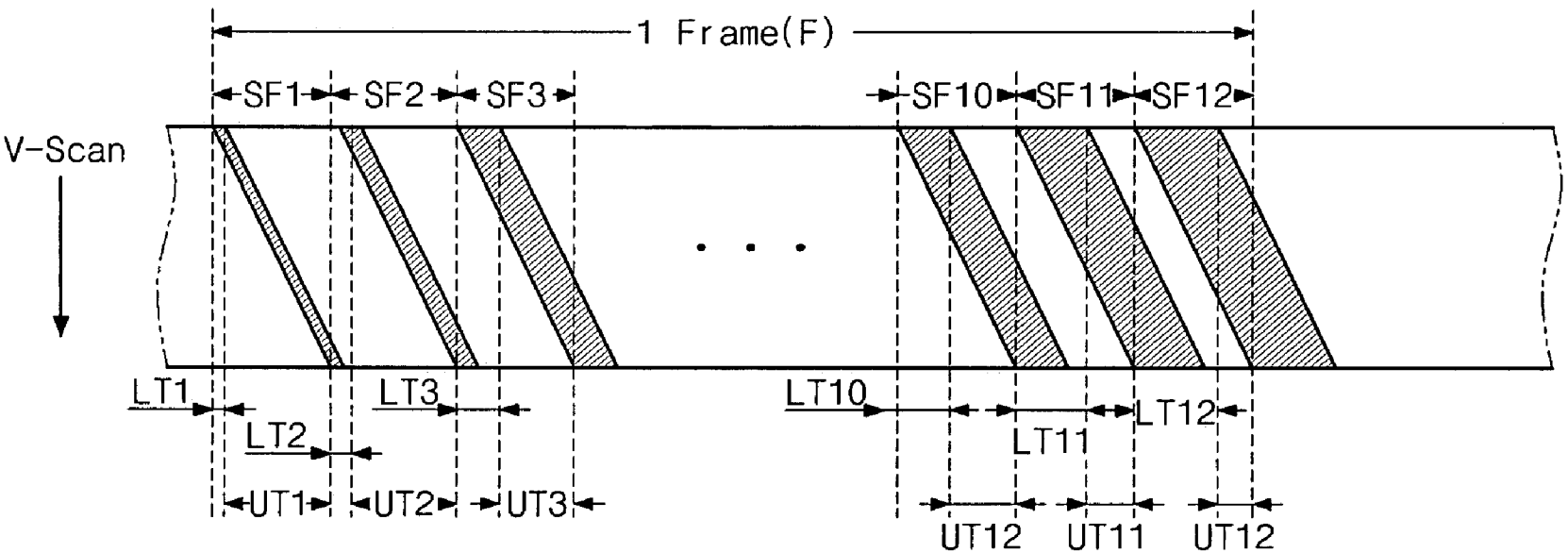
FIG. 5 is a timing diagram for the time division driving method according to the embodiment of the present invention to operate the OELD in FIG. 3.

FIG. 5 is a timing diagram for the time division driving method according to the embodiment of the present invention to drive the OELD in FIG. 3, and Table 2 shows an on-state time of each sub-frame to display a gray-level according to the embodiment of the present invention.

TABLE 2

| Sub-frames on-state time LT (weight value) | | SF12 53 | SF11 47 | SF10 40 | SF9 33 | SF8 26 | SF7 19 | SF6 14 | SF5 10 | SF4 6 | SF3 4 | SF2 2 | SF1 1 |
|---|---|---|---|---|---|---|---|---|---|---|---|---|---|
| Gray-level (data signal) | . | . | . | . | . | . | . | . | . | . | . | . | . |
| | . | . | . | . | . | . | . | . | . | . | . | . | . |
| | . | . | . | . | . | . | . | . | . | . | . | . | . |
| | 125 | 0 | 0 | 1 | 1 | 0 | 1 | 1 | 1 | 1 | 0 | 1 | 1 |
| | 126 | 0 | 0 | 1 | 1 | 0 | 1 | 1 | 1 | 1 | 1 | 0 | 0 |
| | 127 | 0 | 0 | 1 | 1 | 0 | 1 | 1 | 1 | 1 | 1 | 0 | 1 |
| | 128 | 0 | 0 | 1 | 1 | 0 | 1 | 1 | 1 | 1 | 1 | 1 | 0 |
| | 129 | 0 | 0 | 1 | 1 | 0 | 1 | 1 | 1 | 1 | 1 | 1 | 1 |
| | . | . | . | . | . | . | . | . | . | . | . | . | . |
| | . | . | . | . | . | . | . | . | . | . | . | . | . |
| | . | . | . | . | . | . | . | . | . | . | . | . | . |

Referring to FIG. 5 and Table 2, in this embodiment of the present invention, a data signal supplied to the data line DL (in FIG. 4) is a twelve-bit data signal having both a binary code and a non-binary code, and has 256 ($2^8$) gray-level information. In other words, some bits of the data signal may be expressed in the form of a binary code and other bits of the data signal may be expressed in the form of a non-binary code. In this example, the second and third order bits are expressed in the form of a binary code, other bits are expressed in the form of a non-binary code, and the first order bit can be expressed either in the form of a binary code or a non-binary code.

The weight value of a bit of a non-binary code may be lower than the weight value of a bit of a binary code, when the order of the bit of the non-binary code is the same as the order of the bit of the binary code. For example, the weight value of the fourth order bit of the non-binary code is 6 in Table 2, and the weight value of the fourth order bit of the binary code is 8 in Table 1.

The twelve-bit data signal may be converted from a source data signal which is an eight-bit binary code through a data converter DC in FIG. 3, as shown in Table 2. For example, the 8-bit source data signal "00000110" for displaying the $6^{th}$ gray-level is converted to the twelve-bit data signal "000000000100". Because the weight value of a bit of a non-binary code may be lower than the weight value of a bit of a binary code, when the order of the bit of the non-binary code is the same as the order of the bit of the binary code, the number of the bits of the data signal is greater than the number of the bits of the source data signal. In this example, the data signal is a twelve-bit data signal, and the source data signal is an eight-bit data signal having 256 ($2^8$) gray-level information.

One frame interval F may be divided into first to twelfth sub-frames SF1 to SF12 corresponding to the twelve bits of the data signal through a timing controller TC in FIG. 3, respectively. In other words, the first order bit (the lowest order bit) of the data signal corresponds to the first sub-frame SF1, and the second to the twelfth order bits of the data signal correspond to the second to the twelfth sub-frames SF2 to SF12, respectively. Each sub-frame SF has an on-state time LT and an off-state time UT. Because the pixels of the OELD are scanned sequentially along a vertical direction V-scan during each sub-frame SF, each on-state time LT follows the oblique line in FIG. 5 along the vertical direction V-scan.

The on-state time LT of each sub-frame SF corresponds to a weight value of each bit of the data signal. Accordingly, the weight values of the first to the twelve on-state times LT1 to LT12 have the following relationship: LT1:LT2:LT3:LT4:LT5:LT6:LT7:LT8:LT9:LT10:LT11:LT12=1:2:4:6:10:14:19:26:33:40:47:53. Because the on-state time LT of each sub-frame SF corresponds to the weight value of each bit of the data signal, the on-state time LT of each sub-frame SF is expressed either in the form of a binary code or a non-binary code. In this embodiment, the on-state time LT of each sub-frame increases as the sub-frame number becomes higher. In other words, the on-state time LT1 corresponds to the weight value 1, whereas the on-state time LT12 corresponds to the weight value 53. However, it should be understood that according to the principles of the present invention, the weight values of the on-state times LT need not be in increasing order with respect to the sub-frame numbers.

The pixel in FIG. 4 emits light when the corresponding bit of the data signal has a logic value "1" and does not emit light when the corresponding bit of the data signal has a logic value "0" during each sub-frame SF. Accordingly, the on-state time LT is the emission time of the pixel when the logic value is "1". Thus, a gray-level can be displayed by the summation of the emission times during one frame interval F.

When gray-levels are displayed by the time division driving method according to the present invention, all or some of the corresponding bits of the data signals, which display different gray-levels, may have different logic values.

For example, a first data signal is a twelve-bit data signal of "001101111101" for displaying the $127^{th}$ gray-level, and a second data signal is a twelve-bit data signal of "001101111110" for displaying the $128^{th}$ gray-level. The first data signal and the second data signal have different logic values in the first and second order bits. Accordingly, a first pixel displaying the $127^{th}$ gray-level and a second pixel displaying the $128^{th}$ level emits light alternatively during the first and second sub-frames SF1 and SF2. The percentage of alternative emission time for the first pixel with respect to the second pixel during the first and second sub-frames SF1 and SF2 is 0.8% ((1+0)/127*100), and the percentage of alternative emission time for the second pixel is 1.6% ((0+2)/128*100).

In addition, a third data signal is a twelve-bit data signal of "010111111100" for displaying the $159^{th}$ gray-level, when the first data signal is a twelve-bit data signal of "001101111101" for displaying the $127^{th}$ gray level. The first data signal and the third data signal have different logic values in the first, eighth, tenth and eleventh order bits. Accordingly, the first pixel displaying the $127^{th}$ gray-level and a third pixel displaying the $159^{th}$ gray-level emit light alternatively during the first and the first, eighth, tenth and eleventh sub-frames SF1, SF8, SF10 and SF11. The percentage of the alternative emission time for the first pixel during the first, eighth, tenth and eleventh sub-frames SF1, SF8, SF10 and SF11 is 32% ((1+0+40+0)/127*100), and the percentage of the alternative emission time for the third pixel during the first, eighth, tenth and eleventh sub-frames SF1, SF8, SF10 and SF11 is 46% ((0+26+0+47)/128*100).

In the embodiment of the present invention, the data signal has a twelve-bit data signal having both a binary code and a non-binary code, and the weight value of a bit of the non-binary code may be lower than the weight value of a bit of the binary code, when the order of the bit of the non-binary code is the same as the order of the bit of the binary code. Accordingly, the alternative emission times for the pixels, which display different gray levels, are reduced even when the orders of the corresponding bits having different logic values are high.

The time division driving method of the OELD according to the embodiment of the present invention will be further explained with reference to FIGS. 3 to 5 and Table 2.

The on-state gate lines GPL1 to GPLn are scanned sequentially along the vertical direction V-scan during the first on-state time LT1 of the first sub-frame SF1. Accordingly, the first switching transistor ST1 of the pixel connected with the scanned on-state gate line GPL is supplied with the on-state gate signal and is turned on. The first order bits of the data signals are supplied to the scanned pixels P through the data lines DL1 to DLm, respectively. Because the switching transistor ST1 of the scanned pixel P is turned on, the first order bit of the data signal is supplied to the driving transistor DT. The first bit of the data signal may be an on-state signal bit when the first bit of the data signal has a logic value "1", and the first bit of the data signal may be an off-state signal bit when the first bit of the data signal has a logic value "0". Accordingly, when the first bit of the data signal has a logic value "1", the driving transistor DT is turned on and applies the power signal to the organic electro-luminescent D. In contrast, when the first bit of the data signal has a logic value "0", the driving transistor DT is off-state and does not apply the power signal to the organic electro-luminescent D. Thus, the organic electro-luminescent diode emits light during the first on-state time LT1 when the driving transistor DT is turned on.

The off-state time UT1 of each pixel P starts after the first on-state time LT1 of each pixel P. The off-state gate lines GEL1 to GELn are scanned sequentially along the vertical direction V-scan during the first off-state time UT1 of the first sub-frame SF1. The first switching transistor ST1 of the pixel is off-state during the first off-state time UT1, and the second switching transistor ST2 of the pixel connected with the scanned off-state gate line GEL is supplied with the off gate signal and is turned on. Because the second switching transistor ST2 is turned on, the power signal is supplied to the gate electrode of the driving transistor DT. Accordingly, the source and gate electrodes of the driving transistor DT have the same voltage, and thus the driving transistor DT becomes off-state. As a result, the organic electro-luminescent diode D does not emit light during the first off-state time UT1. Then, the second to the twelfth sub-frames SF2 to SF12 follow the first sub-frame SF1 in the same driving method as the first sub-frame SF1, thereby completing the driving of one frame interval.

In the present invention, the data signal is a multiple-bit data signal having both a binary code and a non-binary code, and the on-state time of each sub-frames corresponding to each bit of the data signal is expressed either in the form of a binary code or a non-binary code. In addition, the number of the bits of the data signal is greater than the number of the bits of the source data signal. Accordingly, the alternative emission times for the pixels, which display different gray levels, are reduced even when the orders of the corresponding bits having different logic values are high. As a result, the OELD driven by the time division driving method according to the embodiment of the present invention can reduce the border flicker problem and/or the dynamic false contour problem.

It will be apparent to those skilled in the art that various modifications and variations can be made in the above-discussed display device and the driving method thereof without departing from the spirit or scope of the invention. Thus, it is intended that the present invention cover the modifications and variations of this invention provided they come within the scope of the appended claims and their equivalents.

What is claimed is:

1. A driving method of a flat panel display, comprising:

converting a source data signal to a data signal, wherein the data signal has more bits than the source data signal, wherein the data signal is at least twelve bits;

dividing one frame into a plurality of sub-frames corresponding to the twelve bits of the data signal, wherein each sub-frame includes an on-state time, each on-state time of each sub-frame corresponds to a weight value of each bit of the data signal expressed in a form of a binary code and a non-binary code, wherein the weight values are ratios of the on-state times to the on-state time which is a shortest time among the on-state times, the weight value of the shortest time is 1, and the other weight values are greater than 1;

applying an on-state gate signal to a pixel in each sub-frame to turn on the pixel; and applying each bit of the data signal corresponding to each sub-frame to the pixel, wherein the weight values are expressed in a form of an increasing order such that a weight value of an (X+1)th sub-frame is always greater than a weight value of an Xth sub-frame for all positive integer values of X, and a weight value of a (Y+3)th sub-frame is always less than or equal to a summation of weight values of (Y+2)th and (Y+1)th sub-frames for all positive integer values of Y in the non-binary code part, wherein the sub-frames are in consecutive order of (Y+1)th, (Y+2)th and (Y+3)th, and wherein the weight values of first to third sub-frames of the plurality of sub-frames are expressed in the binary code, and the weight values of other sub-frames are expressed in the non-binary code.

2. The driving method according to claim 1, wherein the flat panel display is an organic electro-luminescence display.

3. The driving method according to claim 2, further comprising:

applying a power signal to the pixel in accordance with each bit during the on-state time of each sub-frame.

4. The driving method according to claim 3, further comprising supplying an off-state gate signal to the pixel after the on-state time of each sub-frame, thereby turning off the pixel.

5. The driving method according to claim 4, wherein the pixel further includes a first switching transistor supplied with the on-state gate signal, a second switching transistor supplied with the off-state gate signal, and a driving transistor connected with an organic electro-luminescent diode.

6. The driving method according to claim 5, wherein the first switching transistor applies each bit of the data signal to the driving transistor in accordance with the on-state gate signal in each sub-frame, thereby the driving transistor applying the power signal to the organic electro-luminescent diode during the on-state time of each sub-frame.

7. The driving method according to claim 5, wherein the second switching transistor applies the power signal to a gate electrode of the driving transistor in accordance with the off-state gate signal in each sub-frame, thereby the driving transistor becoming an off-state and the organic electro-luminescent diode being non-luminous.

8. The driving method according to claim 1, wherein the data signal has the same gray-level information as the source data signal.

9. A flat panel display device, comprising:

a gate driver for applying an on-state gate signal to a pixel in each sub-frame to turn on the pixel;

a data converter for converting a source data signal to a data signal, wherein the data signal has a number of bits greater than the source data signal; and a data driver for applying each bit of the data signal corresponding to each sub-frame to the pixel, wherein the data signal is at least twelve bits; and a timing controller for dividing one frame into a plurality of sub-frames corresponding to the twelve bits of the data signal, wherein each sub-frame includes an on-state time, each on-state time of each sub-frame corresponds to a weight value of each bit of the data signal expressed in a form of a binary code and a non-binary code, wherein the weight values are ratios of the on-state times to the on-state time which is a shortest time among the on-state times, the weight value of the shortest time is 1, and the other weight values are greater than 1, wherein the weight values are expressed in a form of an increasing order such that a weight value of an (X+1)th sub-frame is always greater than a weight value of an Xth sub-frame for all positive integer values of X, and a weight value of a (Y+3)th sub-frame is always less than or equal to a summation of weight values of (Y+2)th and (Y+1)th sub-frames for all positive integer values of Y in the non-binary code part, wherein the sub-frames are in consecutive order of (Y+1)th, (Y+2)th and (Y+3)th, and wherein the weight values of first to third sub-frames of the plurality of sub-frames are expressed in the binary code, and the weight values of other sub-frames are expressed in the non-binary code.

10. The flat panel display device according to claim 9, wherein the flat panel display is an organic electro-luminescence display having an organic electro-luminescent diode in the pixel.

11. The flat panel display device according to claim 10, further comprising:

a power source applying a power signal to the pixel in accordance with each bit during the on-state time of each sub-frame.

12. The flat panel display device according to claim 11, wherein the gate driver further supplies an off-state gate signal to the pixel after the on-state time of each sub-frame, thereby turning off the pixel.

13. The flat panel display device according to claim 12, wherein the pixel further includes a first switching transistor supplied with the on-state gate signal, a second switching transistor supplied with the off-state gate signal, and a driving transistor connected with an organic electro-luminescent diode.

14. The flat panel display device according to claim 13, wherein the first switching transistor applies each bit of the data signal to the driving transistor in accordance with the on-state gate signal in each sub-frame, thereby the driving transistor applying the power signal to the organic electro-luminescent diode during the on-state time of each sub-frame.

15. The flat panel display device according to claim 13, wherein the second switching transistor applies the power signal to a gate electrode of the driving transistor in accordance with the off-state gate signal in each sub-frame, thereby the driving transistor becoming an off-state and the organic electro-luminescent diode being non-luminous.

16. The flat panel display device according to claim 9, wherein the data signal has the same gray-level information as the source data signal.

17. A driving method of a flat panel display device having a pixel, comprising:

converting a N-bit source data signal to a M-bit data signal, the M-bit data signal having both a binary code and a non-binary code, wherein each of N and M is an integer, M is greater than N, a number of the sub-frames is equal to M;

dividing one frame into a plurality of sub-frames, wherein each sub-frame includes an on-state time, and the on-state time of each sub-frame corresponds to a weight value of each bit of the data signal expressed in the form of a binary code and a non-binary code, wherein the weight values are ratios of the on-state times to the on-state time which is a shortest time among the on-state times, the weight value of the shortest time is 1, the other weight values are greater than 1; and applying each bit of the M-bit data signal to the pixel in each sub-frame, wherein M is at least twelve bits, wherein the weight value of the bit in the binary code is expressed in a form of a binary code, wherein the weight values are expressed in a form of an increasing order such that a weight value of an (X+1)th sub-frame is always greater than a weight value of an Xth sub-frame for all positive integer values of X, and a weight value of a (Y+3)th sub-frame is always less than or equal to a summation of weight values of (Y+2)th and (Y+1)th sub-frames for all positive integer values of Y in the non-binary code part, wherein the sub-frames are in consecutive order of (Y+1)th, (Y+2)th and (Y+3)th, and wherein the weight values of first to third sub-frames of the plurality of sub-frames are expressed in the binary code, and the weight values of other sub-frames are expressed in the non-binary code.

18. The driving method according to claim 17, wherein the flat panel display is an organic electro-luminescence display.

19. The driving method according to claim 18, further comprising:

applying a power signal to the pixel in accordance with each bit of the M-bit data signal during the on-state time of each sub-frame.

20. The driving method according to claim 19, further comprising supplying an off-state gate signal to the pixel after the on-state time of each sub-frame, thereby turning off the pixel.

21. The driving method according to claim 20, wherein the pixel further includes a first switching transistor supplied with the on-state gate signal, a second switching transistor supplied with the off-state gate signal, and a driving transistor connected with an organic electro-luminescent diode.

22. The driving method according to claim 21, wherein the first switching transistor applies each bit of the data signal to the driving transistor in accordance with the on-state gate signal in each sub-frame, thereby the driving transistor applying the power signal to the organic electro-luminescent diode during the on-state time of each sub-frame.

23. The driving method according to claim 21, wherein the second switching transistor applies the power signal to a gate electrode of the driving transistor in accordance with the off-state gate signal in each sub-frame, thereby the driving transistor becoming an off-state and the organic electro-luminescent diode being non-luminous.

24. The driving method according to claim 17, wherein the N-bit source data signal has the same gray-level information as the M-bit data signal.

25. A driving method of a flat panel display, comprising:

converting a N-bit source data signal to a M-bit data signal, the M-bit data signal having both a binary code part and a non-binary code part, wherein each of N and M is an integer, M is greater than N;

dividing one frame into a plurality of sub-frames, wherein each sub-frame includes an on-state time each on-state time of each sub-frame corresponds to a weight value of each bit of the data signal expressed in a form of a binary code and a non-binary code, a number of the sub-frames is equal to M, wherein the weight values are ratios of the on-state times to the on-state time which is a shortest time among the on-state times, the weight value of the shortest time is 1, the other weight values are greater than 1; and applying each bit of the M-bit data signal to the pixel in each sub-frame, wherein M is at least twelve bits, wherein the weight value of the bit in the binary code is expressed in a form of a binary code, wherein the weight values are expressed in a form of an increasing order such that a weight value of an (X+1)th sub-frame is always greater than a weight value of an Xth sub-frame for all positive integer values of X, and a weight value of a (Y+3)th sub-frame is always less than or equal to a summation of weight values of (Y+2)th and (Y+1)th sub-frames for all positive integer values of Y in the non-binary code part, wherein the sub-frames are in consecutive order of (Y+1)th, (Y+2)th and (Y+3)th, and wherein the weight values of first to third sub-frames of the plurality of sub-frames are expressed in the binary code, and the weight values of other sub-frames are expressed in the non-binary code.

* * * * *